US005482274A

United States Patent [19]

Bellehumeur

[11] Patent Number: 5,482,274

[45] Date of Patent: Jan. 9, 1996

[54] ROLLER HOCKEY PUCK WITH RECESSED RUNNERS

[76] Inventor: Alex R. Bellehumeur, 6242 Napoli Ct., Long Beach, Calif. 90803

[21] Appl. No.: 301,074

[22] Filed: Sep. 6, 1994

Related U.S. Application Data

[60] Continuation-in-part of Ser. No. 150,420, Nov. 10, 1993, abandoned, which is a division of Ser. No. 949,077, Sep. 22, 1992, Pat. No. 5,275,410.

[51] Int. Cl.[6] ..... A63B 71/00

[52] U.S. Cl. ..... 273/128 R

[58] Field of Search ..... 273/126 R, 128 R

[56] References Cited

U.S. PATENT DOCUMENTS

| | | | |
|---|---|---|---|
| 2,727,744 | 12/1955 | Watson | 273/128 R |
| 3,726,526 | 4/1973 | Radovich | 273/128 R |
| 3,784,204 | 1/1974 | Felber | 273/128 R |
| 4,111,419 | 9/1978 | Pellegrino | 273/128 R X |
| 5,149,096 | 9/1992 | Keating et al. | 273/128 R |
| 5,275,410 | 1/1994 | Bellehumeur et al. | 273/128 R |

FOREIGN PATENT DOCUMENTS

| | | | |
|---|---|---|---|
| 2056181 | 8/1976 | Germany | 273/128 CS |

*Primary Examiner*—Raleigh W. Chiu
*Attorney, Agent, or Firm*—Edgar W. Averill, Jr.

[57] ABSTRACT

A roller hockey puck having at least three runners extending above and below its upper and lower faces. The improvement is that the runners have a head which is retained partially in a recess in the puck. This recess supports the head and reduces the tendency of it to break. The disclosure also shows runners of two sizes. A first size of runners extends a runner height above and below the upper and lower faces of the puck, a second set of runners are referred to as stabilizers and are positioned closer to the upper and lower faces than the runners.

10 Claims, 2 Drawing Sheets

Fig. 4
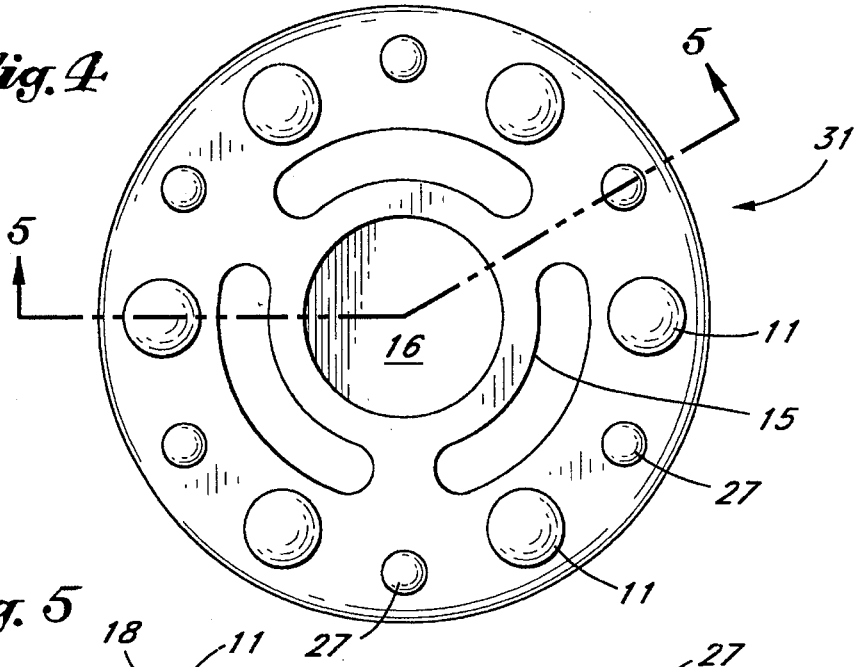
Fig. 5
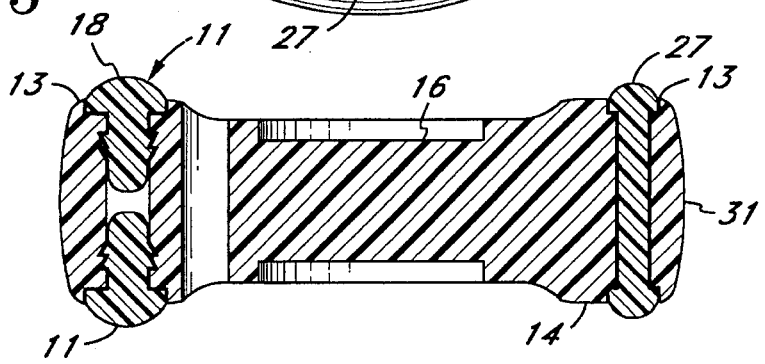
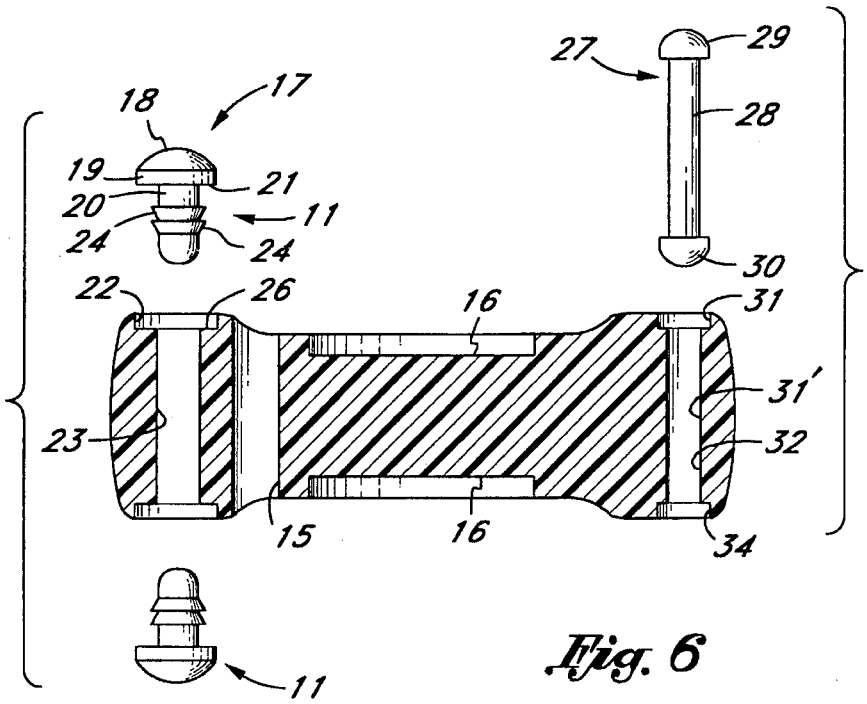
Fig. 6

ROLLER HOCKEY PUCK WITH RECESSED RUNNERS

CROSS REFERENCE TO RELATED APPLICATIONS

The present application is a continuation in part of applicant's application Ser. No. 08/150,420 filed Nov. 10, 1993, now abandoned which in turn was a divisional application of applicant's Ser. No. 07/949,077 filed Sep. 22, 1992, which has issued as U.S. Pat. No. 5,275,410.

BACKGROUND OF THE INVENTION

The field of the invention is sporting goods and the invention relates more particularly to roller hockey pucks of the type described in applicant's U.S. Pat. No. 5,275,410 which is incorporated herein by reference.

Roller hockey pucks are often given rough treatment, for instance, when they are used on asphalt surfaces or rough cement surfaces. Such surfaces tend to wear the tops of the runners or can cause them to break off and additional support for the runner heads would be beneficial. A common roller hockey puck has six runners on each face and occasionally the puck will flip over when it hits a rough spot and means are needed to reduce the tendency of the puck to flip over.

SUMMARY OF THE INVENTION

An object of the present invention is to provide a roller hockey puck with runners which have heads which are securely supported by the puck.

It is another object of the present invention to provide a roller hockey puck which includes stabilizers which decrease the tendency of the puck to flip over during play.

SUMMARY OF THE PRESENT INVENTION

The present invention is for a roller hockey puck having a generally cylindrically outer peripheral surface, an upper face and a lower face, and a plurality of runners extending above and below the upper and lower faces respectively. The present invention is an improvement which comprises a plurality of runners on each face, each of the runners having a head and a shaft and the head having a bottom surface, a side wall, and a top surface. The puck has a recess adjacent the bottom surface of each head which surface extends at least a portion against the side wall of the head. The puck also has openings in which the respective shafts of the runners are retained. Preferably, the recess is at least about 0.005 of an inch. Also preferably, the runners are retained in the openings of the puck by a serrated shaft in each runner. The present invention is also for a puck having stabilizers between each pair of runners and the stabilizers extend a lesser distance above the surface of the puck than do the runners. The present invention is also for a process of inserting the stabilizers wherein a hole having enlarged ends is formed in the puck and a stabilizer having enlarged heads is forcibly inserted into this hole and retained by the enlarged heads positioned in the recesses. The stabilizers prevent the soft material from which the puck is made from touching the surface of play which would slow down the puck and also tend to flip it over onto its peripheral edge or onto its other side.

BRIEF DESCRIPTION OF THE DRAWINGS

FIG. 4 is a plan view of the puck of FIG. 1, further including six stabilizers.

FIG. 5 is a cross-sectional view taken along line 5—5 of FIG. 4.

FIG. 6 is an exploded cross-sectional view of the puck of FIG. 5.

DESCRIPTION OF THE PREFERRED EMBODIMENTS

Figure 1:
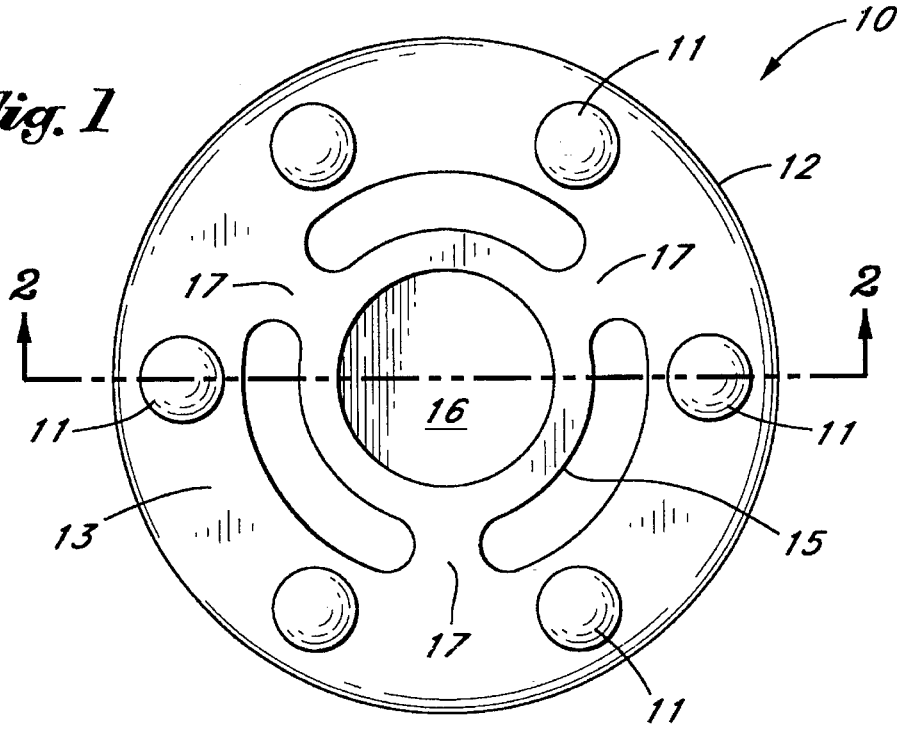
FIG. 1 is a plan view of the puck of the present invention having six runners with recessed heads.

A puck is shown in FIG. 1 in plan view and indicated generally by reference character 10. Puck 10 has six runners 11. Puck 10 has a generally cylindrical outer peripheral surface 12, an upper face 13 and a lower face 14. Puck 10 also has a central portion 15 with a recess 16. Central portion 15 is held to the outer portion of the puck by three spokes 15'.

Figure 2:
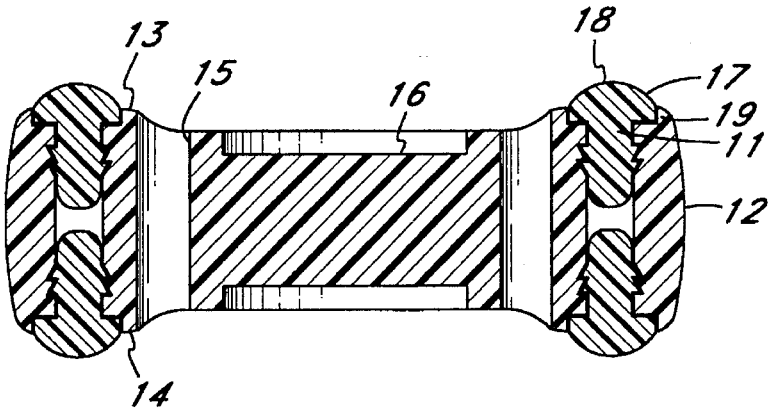
FIG. 2 is a cross-sectional view taken along line 2—2 of FIG. 1.
Figure 3:
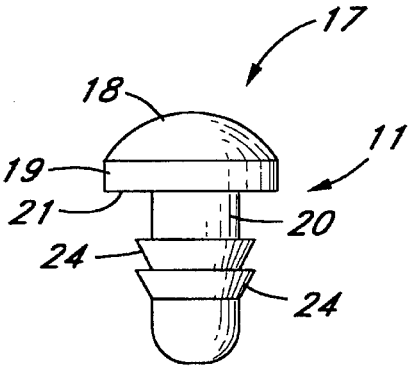
FIG. 3 is an enlarged side view of a runner of the puck of FIG. 1.

FIG. 2 shows the recessed nature of the runners of the present invention. It can be seen that runner 11 has a head 17 with a domed portion 18 and a side wall 19. Head 17 has a bottom surface 21 which extends into a shaft 20 which has a plurality of frusto-conical serrations indicated by reference character 24 in FIG. 3. Runner 11 is forced into opening 23 and the bottom surface 21 of runner 11 abuts the floor 26 of recess 22. Side wall 19 should preferably be at least about 0.005 of an inch high and recess 22 should preferably be at least half this distance, although it is preferred about 0.005 of an inch. The runner would, of course, still be operable if the entire head 19 were domed with the side wall being part of the dome, as long as the bottom is recessed. Furthermore, the runner could have no dome and could have a flat top with a bevel at its intersection with a side wall. The runners are preferably formed from nylon or TEFLON brand of low coefficient of friction polymer or other material having excellent sliding ability (that is, a low coefficient of friction).

A further improvement of the puck of FIG. 1 is shown in FIG. 4 where six stabilizers 27 are positioned between each pair of runners 11. The stabilizers are preferably formed in one piece as shown best in FIG. 6 with a central shaft 28 and enlarged heads 29 and 30. An opening 31' is formed in puck 31 and the opening has a central portion 32 with enlarged ends 33 and 34. Stabilizer 27 may be securely placed in the puck by merely forcing the stabilizer from the position shown in FIG. 6 into the central portion so that enlarged head 30 reaches enlarged end 34. The puck is preferably fabricated from a polymer such as plasticized polyvinyl chloride which has a certain amount of elasticity. The stabilizers, like the runners, are preferably fabricated from nylon or TEFLON which has sufficient strength to be forced into the opening into position. When the stabilizer wears down, it is also possible to force it out of the puck to insert a fresh stabilizer. Similarly, the runners 11 maybe pried out of opening 23.

As shown best in FIG. 5, the runners extend a further distance from the top and bottom surfaces 13 and 14 than does stabilizer 27. In this way, the puck, as it slides along a surface, slides along the domed portion 18 of the runners and only when it starts to tilt does it begin to contact the heads of a stabilizer which tends to return the puck to a flat position on the playing surface. Typically, the runners would extend about 1/10" above the puck surface and the stabilizers about one-half this distance. More specifically, runner heights of 0.115 to 0.095 have been successfully tried and a stabilizer height of 0.060 used in conjunction with runners of 0.115 have been highly successful. A preferred outside diameter of shaft 28 of the stabilizer is 0.156 with a head outside diameter of 0.218". Of course, these dimensions are not intended as limiting but merely as illustrative of preferred sizes.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A roller hockey puck having a generally cylindrical outer peripheral surface, an upper face and a lower face and a plurality of runners having heads extending above and below the upper and lower faces respectively, wherein the improvement comprises:

a plurality of runners on each face, each of said runners having an enlarged head and a shaft and the enlarged head having a bottom surface extending outwardly from the shaft, a side wall and a top surface and the puck having an enlarged recess having a floor and a side wall, the floor being adjacent the bottom surface of each head and said recess extending upwardly from its floor to a face, and the puck having openings extending into the puck from a portion of the floor of the recess and said openings being in direct contact with the respective shafts of the runners which are retained in said openings.

2. The roller hockey puck of claim 1 wherein each recess is at least about 0.05 of an inch deep.

3. The roller hockey puck of claim 1 wherein the runners and the recesses each have a flat bottom.

4. The roller hockey puck of claim 1 wherein the shafts of the runners are serrated.

5. The roller hockey puck of claim 4 wherein each of said shafts have two frusto-conical serrations.

6. The roller hockey puck of claim 4 wherein the openings in the puck which hold the shafts of the runners are smooth walled.

7. The roller hockey puck of claim 1 wherein the puck has six runners on each face.

8. A roller hockey puck having a generally cylindrical outer peripheral surface, an upper face and a lower face and a plurality of runners extending above and below the upper and lower faces respectively a runner height, wherein the improvement comprises:

a plurality of runners on each face, each of said runners having a head and a shaft and the head being larger than the shaft and the head having a bottom surface, a side wall and a top surface, and the puck having runner openings into which the respective shafts of the runners are in direct contact with and are retained thereby and the openings each having an enlarged recess adjacent each face and the recess having a floor and the bottom surface of each runner being in contact with the floor of the recess; and a plurality of stabilizers on each face, each of said stabilizers having a head and a shaft and the head having a bottom surface, a side wall and a top surface, and the puck having stabilizer openings into which the respective shafts of the stabilizers are frictionally retained and the stabilizer having a stabilizer height above and below the upper and lower faces and the stabilizer height being less than the runner height.

9. The roller hockey puck of claim 8 wherein each respective stabilizer shaft has a stabilizer head at each end.

10. A process for retaining a runner means in a roller hockey puck comprising:

molding a puck body having at least three vertical passageways, each passageway having an enlarged portion adjacent an upper face and a lower face of the puck;

forming a plurality of runners having a shaft about the same size as said passageways in said puck body and said runners having an enlarged head at each end having about the same size as said enlarged portion of the passageways; and forcing the runners into the passageways.

* * * * *